US007479952B2

(12) United States Patent
Lee et al.

(10) Patent No.: US 7,479,952 B2
(45) Date of Patent: Jan. 20, 2009

(54) APPARATUS AND METHOD FOR DRIVING PLASMA DISPLAY PANEL

(75) Inventors: Joo-Yul Lee, Suwon-si (KR); Tae-Hyun Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 562 days.

(21) Appl. No.: 11/043,151

(22) Filed: Jan. 27, 2005

(65) Prior Publication Data

US 2005/0168406 A1 Aug. 4, 2005

(30) Foreign Application Priority Data

Jan. 30, 2004 (KR) ..... 10-2004-0005971

(51) Int. Cl.
*G09G 3/28* (2006.01)
*G09G 5/00* (2006.01)

(52) U.S. Cl. ..... 345/204; 345/63; 345/68

(58) Field of Classification Search ..... 345/60–72, 345/37, 204, 211, 690; 313/581–585; 315/169.4
See application file for complete search history.

(56) References Cited

U.S. PATENT DOCUMENTS 6,011,355 A * 1/2000 Nagai ..... 315/169.3
6,597,331 B1 * 7/2003 Kim ..... 345/60
6,628,087 B2 * 9/2003 Roh et al. ..... 315/169.3
2002/0080098 A1 6/2002 Kim
2002/0118149 A1 8/2002 Tanaka et al.
2004/0012547 A1 * 1/2004 Lee ..... 345/60
2004/0239588 A1 * 12/2004 Nagao et al. ..... 345/60

FOREIGN PATENT DOCUMENTS

| | | |
|---|---|---|
| CN | 1405746 | 3/2003 |
| JP | 10-207426 | 8/1998 |
| JP | 2003-288041 | 10/2003 |
| KR | 10-2003-0021482 A | 3/2003 |
| KR | 10-2003-0046849 A | 6/2003 |
| WO | 02-099778 | 12/2002 |

* cited by examiner

*Primary Examiner*—Jimmy H Nguyen
(74) *Attorney, Agent, or Firm*—H.C. Park & Associates, PLC

(57) ABSTRACT

An apparatus and method for driving a plasma display panel. In an idle period, a lowest voltage is applied to each circuit of a driving board of a plasma display panel so that a bootstrap capacitor of a switch driving circuit may enter a chargeable state. Therefore, it is possible not only to make the capacity of the bootstrap capacitor of each circuit small, but also to effectively prevent an abnormal discharge or an abnormal operation of each circuit when an abnormal image is inputted.

11 Claims, 4 Drawing Sheets

APPARATUS AND METHOD FOR DRIVING PLASMA DISPLAY PANEL

CROSS REFERENCE TO RELATED APPLICATION

This application claims priority to and the benefit of Korean Patent Application No. 10-2004-0005971 filed on Jan. 30, 2004, which is hereby incorporated by reference for all purposes as if fully set forth herein.

BACKGROUND OF THE INVENTION

1. Field of the Invention

The present invention relates to a method and apparatus for driving a plasma display panel (PDP), and more particularly to a PDP driving method and apparatus for enhancing sustain discharge efficiency.

2. Description of the Background

Recently, flat panel displays, such as liquid crystal displays (LCDs), field emission displays (FEDs) and PDPs, have been actively developed. The PDPs may have higher luminance, higher luminous efficiency and a wider viewing angle. Therefore, they are considered as a primary substitute for conventional cathode ray tubes (CRTs) for large-screen displays of more than 40 inches.

Generally, the PDPs use plasma generated by gas discharge to display characters or images. They may include, according to their size, more than several thousands to millions of pixels arranged in a matrix format. PDPs may be classified into direct current (DC) and alternating current (AC) types according to their driving voltage waveforms and discharge cell structures.

The DC PDP has electrodes that are exposed in a discharge space, thereby causing current to directly flow through the discharge space when applying a voltage to the DC PDP. One of the disadvantages of the DC PDP is that it requires a resistor to limit this current. On the other hand, the AC PDP has electrodes covered with a dielectric layer that naturally forms a capacitance component to limit the current and protects the electrodes from ion impact during a discharge. Consequently, the AC PDP has a longer lifespan than the DC PDP.

FIG. 1 is a partial perspective view of a conventional AC PDP.

As shown in FIG. 1, scan electrodes 4 and sustain electrodes 5, which may be covered with a dielectric layer 2 and a protection film 3, are arranged in parallel pairs on a first glass substrate 1. A plurality of address electrodes 8, which are covered with an insulation layer 7, may be arranged on a second glass substrate 6. Barrier ribs 9 may be formed on the insulation layer 7 in parallel with, and in between, the address electrodes 8. A phosphor 10 may be coated on the surface of the insulation layer 7 and on both sides of the barrier ribs 9. The first and second glass substrates 1 and 6 face each other while defining a discharge space 11 therebetween so that the address electrodes 8 are orthogonal to the scan electrodes 4 and sustain electrodes 5. In the discharge space 11, discharge cells 12 are formed at intersections between the address electrodes 8 and the pairs of scan electrodes 4 and sustain electrodes 5, respectively.

FIG. 2 shows a typical electrode arrangement in the conventional PDP.

As shown in FIG. 2, the PDP's electrodes may be arranged in the form of an m×n matrix. In detail, address electrodes $A_1$ to $A_m$ may be arranged in a column direction, and scan (Y) electrodes $Y_1$ to $Y_n$ and sustain (X) electrodes $X_1$ to $X_n$ may be alternately arranged in a row direction. Discharge cells 12 shown in FIG. 2 correspond to the discharge cells 12 in FIG. 1.

FIG. 3 is a waveform diagram showing driving waveforms of a conventional PDP.

In a conventional PDP driving method, as shown in FIG. 3, one frame may be divided into a plurality of sub-fields, each of which may comprise a reset period, an address period and a sustain period.

In the reset period, wall charges formed by a previous sustain discharge are erased, and then wall charges are set up to stably perform a subsequent address discharge. In the address period, cells that are turned on and cells that are not turned on are selected, and wall charges accumulate on the turned-on cells (i.e., addressed cells). In the sustain period, a sustain discharge pulse is alternately applied to the X and Y electrodes to perform a sustain discharge to actually display an image on the addressed cells.

Here, the term "wall charges" refers to charges that are formed proximate to the electrodes on the wall (for example, dielectric layer) of the discharge cells and stored on the electrodes. The wall charges do not actually touch the electrodes themselves because the is dielectric layer covers the electrodes. However, for simplicity of description, the wall charges may be described herein as being "formed on", "stored on" and/or "accumulated on" the electrodes.

When a moving image is provided on a frame-by-frame basis, a driving waveform is typically designed on the basis of a shortest-time frame because periods of respective frames of a signal inputted from a video processor may not be constant due to factors such as an image type, etc. Consequently, as FIG. 3 shows, an idle period may exist between frames.

Since the PDP generally has high power consumption due to its driving characteristics, a method for controlling power consumption, according to a load factor of a frame to be displayed, may be used. An auto power control (APC) operation has been proposed as such a power consumption control method. This method may reduce the number of sustain discharges when displaying a bright picture and increase the discharges when displaying a dark picture. Consequently, a long idle period may exist between a frame corresponding to a displayed bright picture and the next frame.

The idle period may be included between the sustain period of the last sub-field of the previous frame and the reset period of the first sub-field of the next frame, or in the sustain period of a frame's last sub-field. Therefore, in the idle period, voltages at the X and Y electrodes may be maintained in their last states of sustain discharge. That is, one of the X and Y electrodes may be maintained at a sustain discharge voltage, which is a high-level voltage, and the other is maintained at a low-level voltage. In the idle period of FIG. 3, a voltage of 0V is applied to the X electrode and a voltage of Vs is applied to the Y electrode.

A conventional PDP driving circuit, which generates a driving waveform, may include a reset driver for generating slowly rising and falling waveforms in the reset period, a scan driver for applying a scan pulse to the Y electrodes in the address period, and a sustain driver for generating a sustain discharge pulse in the sustain period.

Transistors may be formed as switches in the reset, scan and sustain drivers. A capacitor that is pre-charged with a desired voltage to supply the desired voltage may be provided in the reset and scan drivers. These capacitors (Cset and Csc, shown in FIG. 7) may be charged with the desired voltages through switches in the reset driver and scan driver, and slowly discharged when applying a sustain discharge voltage to the Y electrode.

A bootstrap capacitor may be formed in a voltage source of a circuit for driving each switch of each part. The bootstrap capacitor acts to supply a stable voltage.

FIG. 4 is a circuit diagram showing a conventional circuit for driving a switch FET.

As shown in FIG. 4, in order to drive the switch FET, a push-pull circuit including a bootstrap capacitor Cboot and transistors Q1 and Q2, connected to a gate control voltage source Vg, may be used. Turning the transistors Q1 and Q2 on/off drives the switch FET. The bootstrap capacitor Cboot is charged with a voltage Vcc, which may equal 15V, when the source voltage of the switch FET is low. The charged voltage is used to drive the switch FET. Here, the voltage source Vg is a bias voltage source for the transistors Q1 and Q2.

As mentioned above, the voltage Vs is applied to the Y electrode in the idle period. If the idle period is lengthened, the voltage Vs may be continuously applied to the source of the switch FET, so that the bootstrap capacitor Cboot discharges. Consequently, when the next frame starts, the transistors may not be normally driven, thereby causing lowered voltages to be charged in the capacitors Cset and Csc.

Therefore, a normal reset voltage or normal scan voltage may not be supplied. A large-capacitance capacitor, which increases a discharge time, may solve this problem, but this solution may not be desirable.

SUMMARY OF THE INVENTION

The present invention provides a PDP driving method and apparatus that may be capable of preventing an abnormal discharge and an abnormal operation of a driving circuit.

Additional features of the invention will be set forth in the description which follows, and in part will be apparent from the description, or may be learned by practice of the invention.

The present invention discloses a method for driving a PDP including a plurality of first electrodes, a plurality of second electrodes, a plurality of third electrodes crossing the first electrodes and the second electrodes, and discharge cells formed by the first electrodes, the second electrodes, and the third electrodes. A frame is divided into a plurality of subfields, and a subfield comprises a reset period, an address period, and a sustain period. A discharge cell is selected by applying a pulse to a first electrode in the address period. The method comprises in an idle period, applying to the first electrode a lowest voltage applied to the first electrode in the reset period or the address period.

The present invention also discloses an apparatus for driving a plasma display panel by applying voltages to a first electrode and a second electrode, comprising a first sustain driver, a scan unit, a first switch, a main current path, a second switch, and a third switch. The first sustain driver applies a sustain discharge voltage to the first electrode. The scan unit selectively applies a first voltage supplied from a first voltage source and a second voltage supplied from a second voltage source to the first electrode, and the second voltage is lower than the first voltage. The first switch is coupled between the first voltage source and the second voltage source. The main current path is coupled to the first electrode through the scan unit. The second switch is coupled between the main current path and a third voltage source that supplies a third voltage, which is a voltage for sustain discharge. The third switch is coupled between the main current path and a fourth voltage source that supplies a fourth voltage. In an idle period, the first switch is turned on to apply the second voltage to the first electrode.

The present invention also discloses an apparatus for driving a plasma display panel by applying voltages to a first electrode and a second electrode comprising a first sustain driver, a scan unit, and a second sustain driver. The first sustain driver applies a sustain discharge voltage to the first electrode, and the scan unit selectively applies a scan voltage to the first electrode. The second sustain driver includes a first switch and a second switch. The first switch is coupled between the second electrode and a first voltage source that supplies a first voltage, which is a voltage for sustain discharge. The second switch is coupled between the second electrode and a second voltage source that supplies a second voltage. In an idle period, the second switch is turned on to apply the second voltage to the second electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Figure 1:
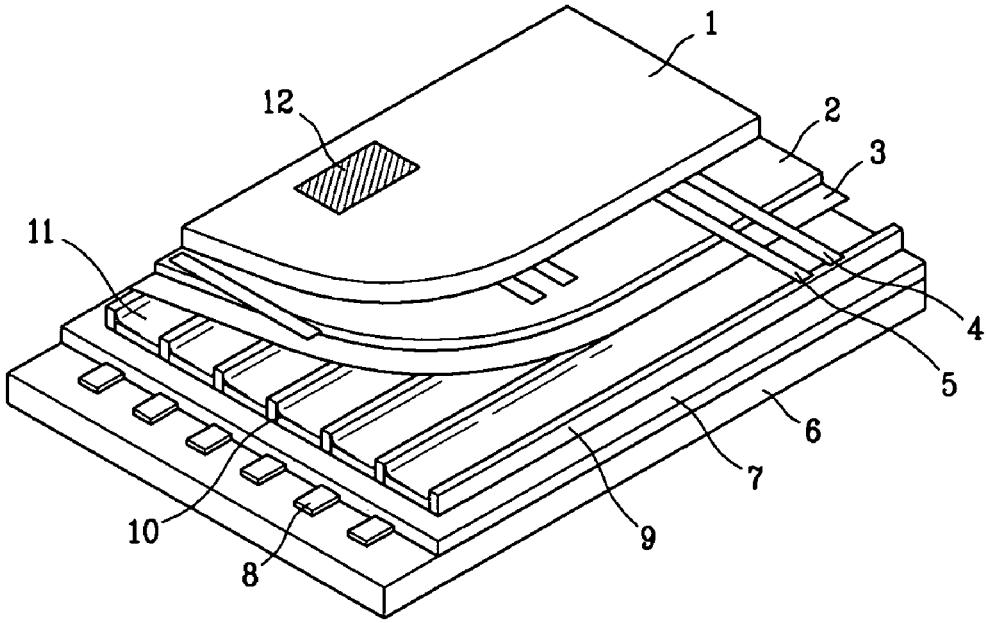
FIG. 1 (Prior Art)
FIG. 1 is a partial perspective view showing a conventional AC PDP.
Figure 2:
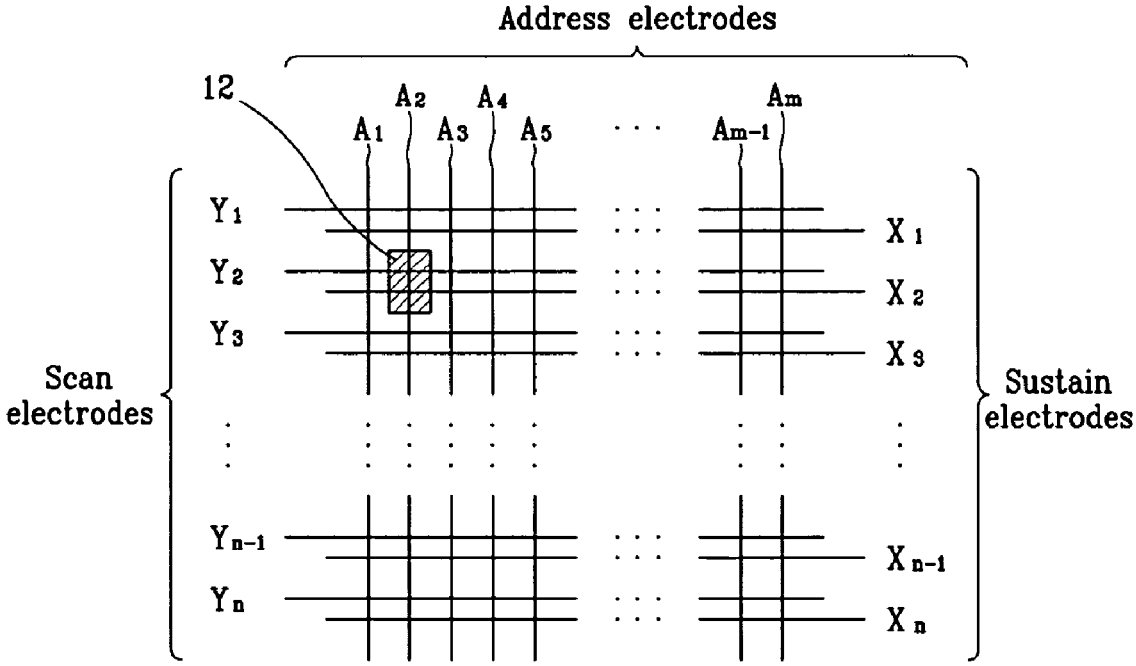
FIG. 2 (Prior Art)
FIG. 2 shows a typical electrode arrangement of a conventional PDP.
Figure 3:
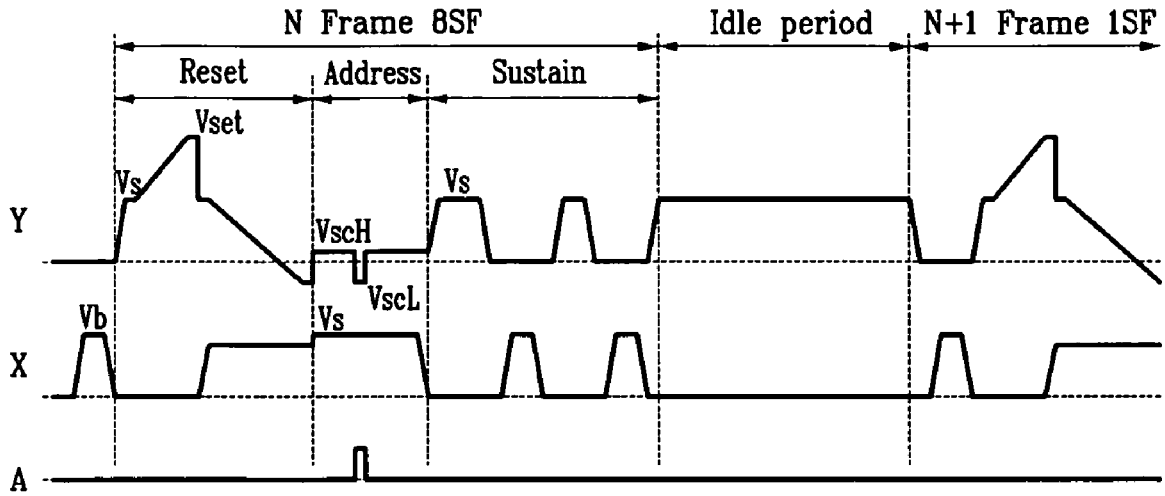
FIG.3(Prior Art)
FIG. 3 is a waveform diagram showing driving waveforms of a conventional PDP.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. In the drawings, illustrations of elements having no relation with the present invention are omitted in order to prevent the subject matter of the present invention from being unclear. In the specification, the same or similar elements may be denoted by the same reference numerals even though they are depicted in different drawings.

Figure 5:
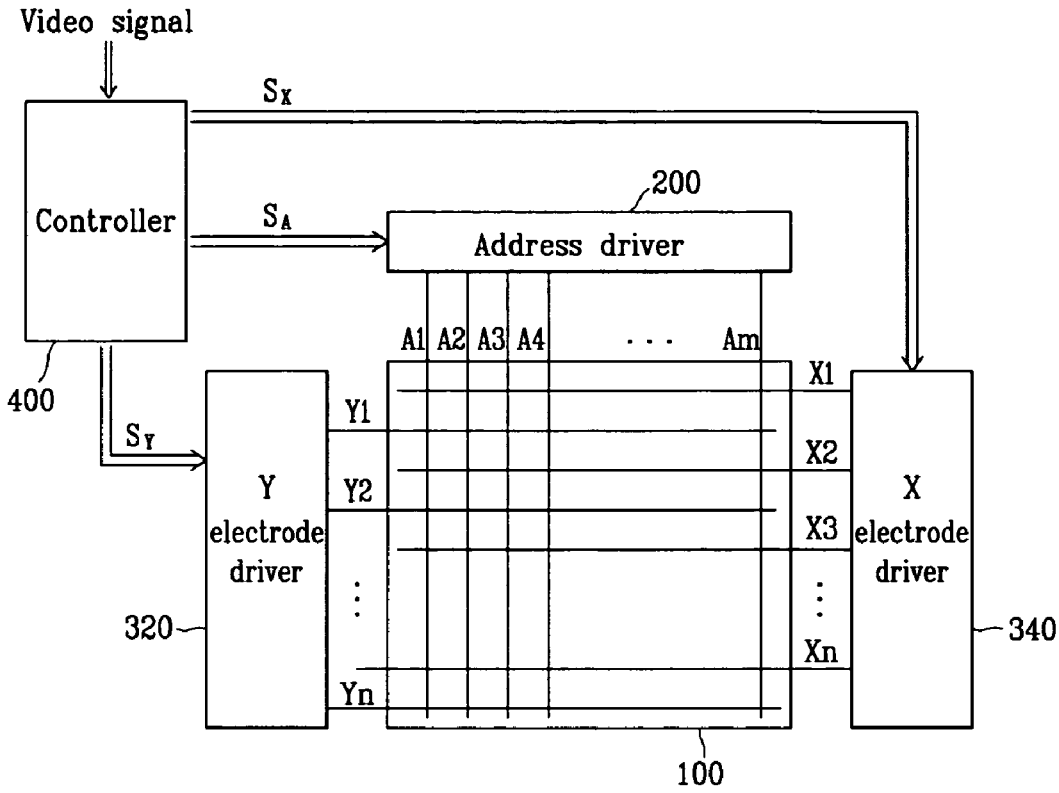
FIG. 5 shows the configuration of a PDP according to an exemplary embodiment of the present invention.

FIG. 5 shows a configuration of a PDP according to an exemplary embodiment of the present invention.

Referring to FIG. 5, the PDP may comprise a plasma panel 100, an address driver 200, a Y electrode driver 320, an X electrode driver 340 and a controller 400.

The plasma panel 100 may include a plurality of address electrodes $A_1$ to $A_m$ arranged in a column direction, and a plurality of scan (Y) electrodes $Y_1$ to $Y_n$ and a plurality of sustain (X) electrodes $X_1$ to $X_n$ alternately arranged in a row direction.

The address driver 200 receives an address driving control signal $S_A$ from the controller 400 and applies display data signals to the address electrodes $A_1$ to $A_m$ to select desired discharge cells.

The Y electrode driver 320 and the X electrode driver 340 receive a Y electrode driving signal $S_Y$ and an X electrode driving signal $S_X$ from the controller 400 and apply driving voltages to the Y electrodes and the X electrodes, respectively.

The controller 400 receives a video signal, generates the address driving control signal $S_A$, the Y electrode driving signal $S_Y$ and the X electrode driving signal $S_X$, and transfers the generated signals to the address driver 200, the Y electrode driver 320 and the X electrode driver 340, respectively.

Figure 6:
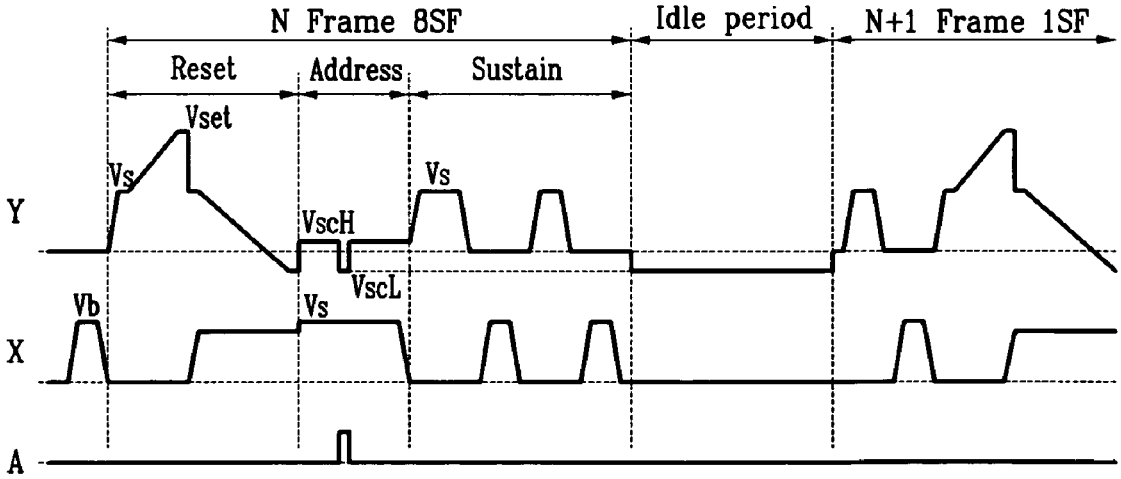
FIG. 6 is a waveform diagram showing driving waveforms of the PDP according to an exemplary embodiment of the present invention.
Figure 7:
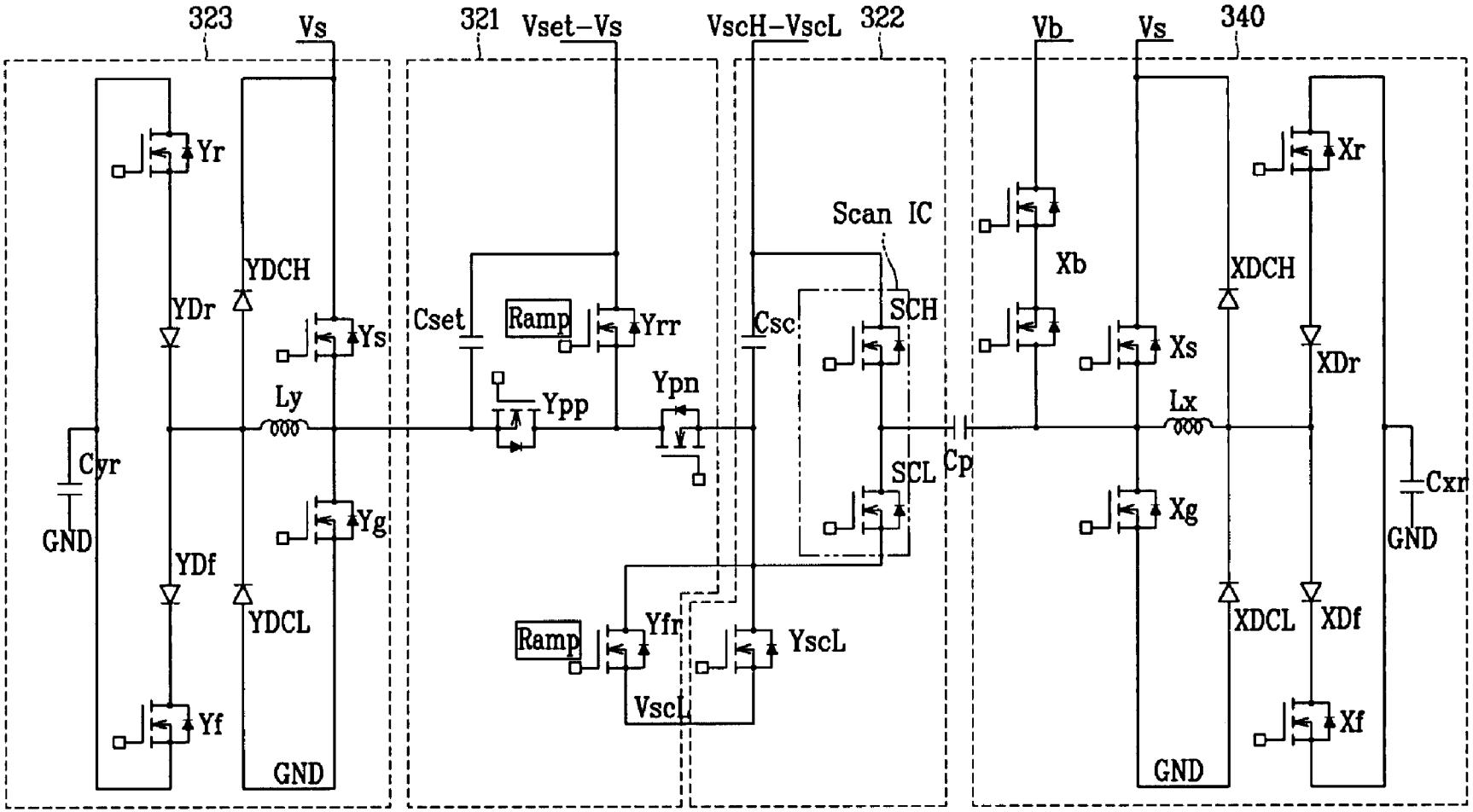
FIG. 7 is a detailed circuit diagram of X and Y electrode drivers that generate driving waveforms of the PDP according to an exemplary embodiment of the present invention.

FIG. 6 is a waveform diagram showing driving waveforms of the PDP according to an exemplary embodiment of the present invention, and FIG. 7 is a circuit diagram showing the driving circuit of the PDP according to an exemplary embodiment of the present invention.

In the PDP according to an exemplary embodiment of the present invention, a bootstrap capacitor of the driving circuit may be charged in an idle period so that the circuit may be normally operated, even when the idle period is lengthened. Because the bootstrap capacitor may be charged when applying a lowest voltage to each part of the driving circuit, the present invention may apply the lowest voltage to each part of the driving circuit in the idle period.

That is, as FIG. 6 shows, in the idle period, a scan voltage VscL may be applied to the Y electrode and a voltage of 0V may be applied to the X electrode.

FIG. 7 is a detailed circuit diagram showing the X and Y electrode drivers that generate the driving waveforms of the PDP according to an exemplary embodiment of the present invention.

As shown in FIG. 7, the driving circuit of the PDP may include the X electrode driver 340 and the Y electrode driver 320 (FIG. 5), which includes a reset driver 321, a scan driver 322 and a sustain driver 323.

The reset driver 321 may include a rising ramp generator for generating a rising reset waveform in a reset period. The rising ramp generator may include a voltage source Vset-Vs for supplying a voltage Vset-Vs, a capacitor Cset operated with a floating voltage, a ramp switch Yrr, and a switch Ypp for preventing a reverse current flow. The switch Ypp may be formed on a main current path, along which a sustain discharge voltage generated by the sustain driver 323 may be applied to a panel capacitor Cp. The reset driver 321 may further include a falling ramp generator for generating a falling reset waveform in the reset period. The falling ramp generator may include a ramp switch Yfr coupled to a voltage source VscL of the scan driver 322 and a switch Ypn for preventing a reverse current flow. The switch Ypn may be formed on the main current path.

Before the reset period, the capacitor Cset may be charged with the voltage Vset-Vs, which may be supplied from the voltage source Vset-Vs when a switch Yg turns on. At the beginning of the reset period, a switch Ys may turn on to apply a voltage Vs to a Y electrode of the panel capacitor Cp. Subsequently, when the switch Yrr turns on, a voltage of the Y electrode of the panel capacitor Cp gradually rises to a voltage Vset due to the voltage charged in the capacitor Cset.

Thereafter, with the switch Ys on, the switch Yrr may turn off to apply the voltage Vs to the Y electrode. When the switch Ys turns off and the switch Yfr turns on, the voltage at the Y electrode may gradually fall to a voltage VscL.

The scan driver 322, which may generate a scan pulse in an address period, may include the voltage source VscL, a voltage source VscH-VscL, a capacitor Csc, a switch YscL, and a Scan IC. The Scan IC may include switches SCH and SCL. The source of the switch SCH and the drain of the switch SCL may be coupled in common to the Y electrode of the panel capacitor Cp.

The switch YscL may remain on in the address period. When a Y electrode is selected, the switch SCL may turn on to apply the voltage VscL to the Y electrode. However, when the Y electrode is not selected, a voltage charged in the capacitor Csc by the voltage source VscH-VscL may be applied to the Y electrode through the switch SCH.

The sustain driver 323, which may generate a sustain discharge pulse in a sustain period, may include the switches Ys and Yg coupled between a voltage source Vs and a ground terminal GND, a capacitor Cyr, switches Yr and Yf for power recovery, an inductor Ly, and diodes YDr, YDf, YDCH and YDCL.

A voltage Vs/2 may be charged in the capacitor Cyr before the sustain period. In the sustain period, when the switch Yr turns on, resonance may occur between the inductor Ly and the panel capacitor Cp, thereby charging the panel capacitor Cp. Thereafter, the voltage Vs may be supplied to the panel capacitor Cp through the switch Ys. Also, when the switch Yf turns on, resonance may occur between the inductor Ly and the panel capacitor Cp, thereby discharging the panel capacitor Cp. Thereafter, the voltage of the panel capacitor Cp may be maintained at 0V through the switch Yg.

The diodes YDr and YDf may be formed in opposite directions to body diodes of the switches Yr and Yf to block current flow resulting from the body diodes, respectively. The diodes YDCH and YDCL clamp the voltage Vs and a secondary voltage of the inductor Ly, respectively.

The X electrode driver 340 may include a voltage source Vb and switch Xb to apply an erase pulse to an X electrode of the panel capacitor Cp in the reset period, switches Xs and Xg coupled between the voltage source Vs and the ground terminal GND to apply a sustain discharge pulse in the sustain period, a capacitor Cxr, switches Xr and Xf for power recovery, an inductor Lx, and diodes XDr, XDf, XDCH and XDCL.

The switches Xs and Xg, capacitor Cxr, switches Xr and Xf, inductor Lx and diodes XDr, XDf, XDCH and XDCL of the X electrode driver 340 may perform the same functions as those of the switches Ys and Yg, capacitor Cyr, switches Yr and Yf, inductor Ly and diodes YDr, YDf, YDCH and YDCL of the sustain driver 323 of the Y electrode driver 320, respectively. Hence, a description thereof will be omitted.

Here, the panel capacitor Cp is an equivalent expression of a capacitance component between an X and Y electrode pair.

In FIG. 7, the switches of the respective parts are shown to be n-channel MOSFETs for illustrative purposes, and they may include body diodes.

The driving circuit described above may apply the waveforms of FIG. 6 to the X and Y electrodes in the idle period in the following manner.

Because the voltage of 0V may be applied to the X electrode in the idle period, as shown in FIG. 6, the switch Xg in the X electrode driver 340 in FIG. 7 may be turned on and all remaining switches therein may be turned off.

Also, since the voltage VscL may be applied to the Y electrode in the idle period, the switch YscL, and the switch SCL of the Scan IC, in the scan driver 322 may be turned on with the switch Ypn off. As a result, the voltage VscL may be applied to the Y electrode along a path of switch SCL-switch YscL, and the source voltage of the switch Ypn may also become the voltage VscL. Consequently, a voltage VscH may be charged in the capacitor Csc in the idle period.

Further, a lowest voltage of 0V may be applied to the sustain driver 323 and the reset driver 321 by turning the switch Yg on with the switch Ypp on, thereby causing the sustain driver 323 and reset driver 321 to enter an idle state.

Accordingly, the voltage Vset may be charged in the capacitor Cset in the idle period.

Figure 4:
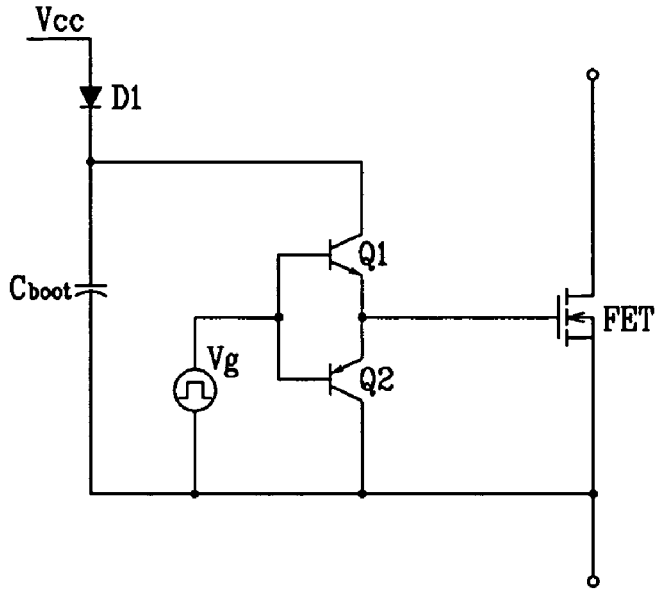
FIG.4(Prior Art)
FIG. 4 is a circuit diagram showing a conventional switch driving circuit.

Furthermore, since the source voltages of the switches Ys, Ypp, Yrr and Ypn may be maintained at a low voltage (e.g. 0V or voltage VscL), in the idle period, the bootstrap capacitor Cboot in the switch driving circuit shown in FIG. 4 may be charged.

Thus, even when the next frame is driven after finishing the idle period, the switches of the driving circuit may be normally operated and sufficient voltages may be charged in the capacitors Cset and Csc.

Although applying a lowest voltage to the Y electrode in the idle period has been described in exemplary embodiments of the present invention, the present invention is not limited thereto. For example, the lowest voltage may also be applied to the X electrode in the idle period in the same manner.

As is apparent from the above description, according to exemplary embodiments of the present invention, in an idle period, a lowest voltage may be applied to each circuit of a driving board of a PDP so that a bootstrap capacitor of a switch driving circuit may enter a chargeable state. Therefore, it may be possible not only to make the capacitance of the bootstrap capacitor of each circuit small, but also to effectively prevent an abnormal discharge or an abnormal operation of each circuit when an abnormal image is inputted.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel including a plurality of first electrodes, a plurality of second electrodes, a plurality of third electrodes crossing the first electrodes and the second electrodes, and discharge cells formed by the first electrodes, the second electrodes, and the third electrodes, wherein a frame is divided into a plurality of subfields, and a subfield comprises a reset period, an address period, and a sustain period, wherein a discharge cell is selected by applying a pulse to a first electrode in the address period, the method comprising:

in an idle period, applying, to the first electrode, a lowest voltage applied to the first electrode in the reset period or the address period, the lowest voltage being applied and having a constant non-zero value for the entire idle period, wherein the idle period is the entire period extending from an end of a first frame to a start of a second frame immediately subsequent to the first frame.

2. The method of claim 1, further comprising:

applying a waveform falling from a first voltage to a second voltage to the first electrode in the reset period, wherein the lowest voltage is the second voltage.

3. The method of claim 1, further comprising:

applying a scan pulse changing from a third voltage to a fourth voltage to the first electrode in the address period, wherein the lowest voltage is the fourth voltage.

4. The method of claim 3, further comprising:

applying a waveform falling from a first voltage to a second voltage to the first electrode in the reset period, wherein the second voltage equals the fourth voltage.

5. The method of claim 1, further comprising:

in the idle period, applying, to a second electrode, a lowest voltage applied to the second electrode in the reset period or the address period.

6. An apparatus for driving a plasma display panel by applying voltages to a first electrode and a second electrode, wherein a frame is divided into a plurality of subfields, and a subfield comprises a reset period, an address period, and a sustain period, comprising:

a first sustain driver for applying a sustain discharge voltage to the first electrode;

a scan unit for selectively applying a first voltage supplied from a first voltage source and a second voltage supplied from a second voltage source to the first electrode;

a first switch coupled between the first voltage source and the second voltage source;

a main current path coupled to the first electrode through the scan unit;

a second switch coupled between the main current path and a third voltage source that supplies a third voltage for a sustain discharge; and a third switch coupled between the main current path and a fourth voltage source that supplies a fourth voltage, wherein the second voltage is lower than the first voltage; and wherein, in an idle period, the first switch is turned on to apply the second voltage to the first electrode, the second voltage being applied to the first electrode and having a constant non-zero value for the entire idle period, wherein the idle period is the entire period extending from an end of a first frame to a start of a second frame immediately subsequent to the first frame.

7. The apparatus of claim 6, wherein the scan unit includes a first capacitor; and wherein the first switch is turned on to charge the first capacitor.

8. The apparatus of claim 6, further comprising:

a reset driver coupled between a node of the second switch and the third switch and the scan unit, wherein the reset driver comprises a second capacitor charged with a fifth voltage, and a fourth switch for applying a slowly rising reset waveform to the first electrode; and wherein, in the idle period, the third switch is turned on to charge the second capacitor.

9. The apparatus of claim 6, further comprising:

a fifth switch disposed on the main current path, wherein, in the idle period, the fifth switch is turned off to cut off the main current path.

10. The apparatus of claim 6, further comprising:

a second sustain driver including:

a sixth switch coupled between the second electrode and a fifth voltage source that supplies a sixth voltage, and a seventh switch coupled between the second electrode and a sixth voltage source that supplies a seventh voltage, wherein the sixth voltage is a voltage for a sustain discharge; and wherein, in the idle period, the seventh switch is turned on to apply the seventh voltage to the second electrode.

11. An apparatus for driving a plasma display panel by applying voltages to a first electrode and a second electrode, wherein a frame is divided into a plurality of subfields, and a subfield comprises a reset period, an address period, and a sustain period, comprising:

a first sustain driver for applying a sustain discharge voltage to the first electrode;

a scan unit for selectively applying a scan voltage to the first electrode; and a second sustain driver including:

a first switch coupled between the second electrode and a first voltage source that supplies a first voltage, and a second switch coupled between the second electrode and a second voltage source that supplies a second voltage, wherein the first voltage is a voltage for a sustain discharge; and wherein, in an idle period, the second switch is turned on to apply the second voltage to the second electrode, wherein a lowest voltage applied to the first electrode in the reset period or the address period is applied and has a constant non-zero value for the entire idle period, wherein the idle period is the entire period extending from an end of a first frame to a start of a second frame immediately subsequent to the first frame.

* * * * *